US005695047A

United States Patent [19]

Tanahashi

[11] Patent Number: 5,695,047

[45] Date of Patent: Dec. 9, 1997

[54] KEY SWITCH DEVICE

[75] Inventor: Naokazu Tanahashi, Nagoya, Japan

[73] Assignee: Brother Kogyo Kabushiki Kaisha, Nagoya, Japan

[21] Appl. No.: 680,774

[22] Filed: Jul. 16, 1996

[30] Foreign Application Priority Data

Jul. 28, 1995 [JP] Japan ..... 7-192974

[51] Int. Cl.[6] ..... H01H 13/70

[52] U.S. Cl. ..... 200/344; 200/341

[58] Field of Search ..... 200/344, 341, 200/345, 520, 512

[56] References Cited

U.S. PATENT DOCUMENTS

| | | | |
|---|---|---|---|
| 4,580,022 | 4/1986 | Oelsch et al. | 200/344 |
| 5,268,545 | 12/1993 | Bruner | 200/344 |
| 5,278,371 | 1/1994 | Watanabe et al. . | |
| 5,278,374 | 1/1994 | Takagi et al. | 200/344 |

FOREIGN PATENT DOCUMENTS 5-225858 9/1993 Japan .

*Primary Examiner*—David J. Walczak
*Attorney, Agent, or Firm*—Oliff & Berridge

[57] ABSTRACT

A key switch device including a key top including a first holding portion and a second holding portion; a holding member including a third holding portion in confrontation with the first holding portion and a fourth holding portion in confrontation with the second holding portion, the holding member formed with an open portion adjacent to at least one of the third holding member and fourth holding member; and a scissor-like guide support member disposed between the key top and the holding member and including a first link member supported by the first holding portion and the fourth holding portion, a second link member supported by the second holding portion and the third holding portion, and a shaft portion pivotally supporting the first link member and the second link member, the guide support member guiding the key top in a vertical direction by switching between an open-scissor condition and a closed-scissor condition according to scissor-like movements of the first link member and second link member pivotally supported on the shaft support, the guide support member including at least one protrusion engaging with the open portion for preventing separation between the guide support member and the holding member.

15 Claims, 5 Drawing Sheets

KEY SWITCH DEVICE

BACKGROUND OF THE INVENTION

1. Field of the Invention

The present invention relates to a key switch device used in a variety of electronic equipment, such as lap top computers.

2. Description of the Related Art

U.S. Pat. No. 5,278,371 discloses a key switch device with guide support members supporting key tops. The guide support members are made from two hinge members, each formed with outward-protruding holding pins. Elongated channel-shaped holding portions for holding the holding pins are provided directly on a support plate. That is, the outward-protruding holding pins of the guide support member are held in place by the elongated channel-shaped holding portions. As a result, there is no need to provide a holder plate, which has been necessary up until then for holding the guide support member in place. As a result, fewer components are required, so that the cost of producing the key switch device is lower.

SUMMARY OF THE INVENTION

However, with this simple configuration, when the guide support member is bent during operation of the key switch device, the holding pin can shift horizontally and separate from the holding portion. In other words, there is a danger that the holding pin will shift in the opposite direction in which the holding portion holds the holding pin.

It is an objective of the present invention to overcome the above-described problem and to provide a key switch device which is easy to use and wherein the guide support member does not easily separate from the support plate.

In order to achieve the above-described objectives, a key switch device includes: a key top including a first holding portion and a second holding portion; a holding member including a third holding portion in confrontation with the first holding portion and a fourth holding portion in confrontation with the second holding portion, the holding member formed with an open portion adjacent to at least one of the third holding member and fourth holding member; and a scissor-like guide support member disposed between the key top and the holding member and including a first link member supported by the first holding portion and the fourth holding portion, a second link member supported by the second holding portion and the third holding portion, and a shaft portion pivotally supporting the first link member and the second link member, the guide support member guiding the key top in a vertical direction by switching between an open-scissor condition and a closed-scissor condition according to scissor-like movements of the first link member and second link member pivotally supported on the shaft support, the guide support member including at least one protrusion engaging with the open portion and for preventing separation between the guide support member and the holding member.

A method of assembling a key switch according to the present invention includes the steps of: assembling a scissor-like guide member by pivotally supporting a first link member with respect to a second link member; fitting a pair of holding pins of the first link member to a pair of first holding portions of a base plate; altering posture of the guide member to engage a protrusion of the first link member in a hole in the base plate; and fitting a pair of holding pins of the second link member to a pair of second holding portions of the base plate.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
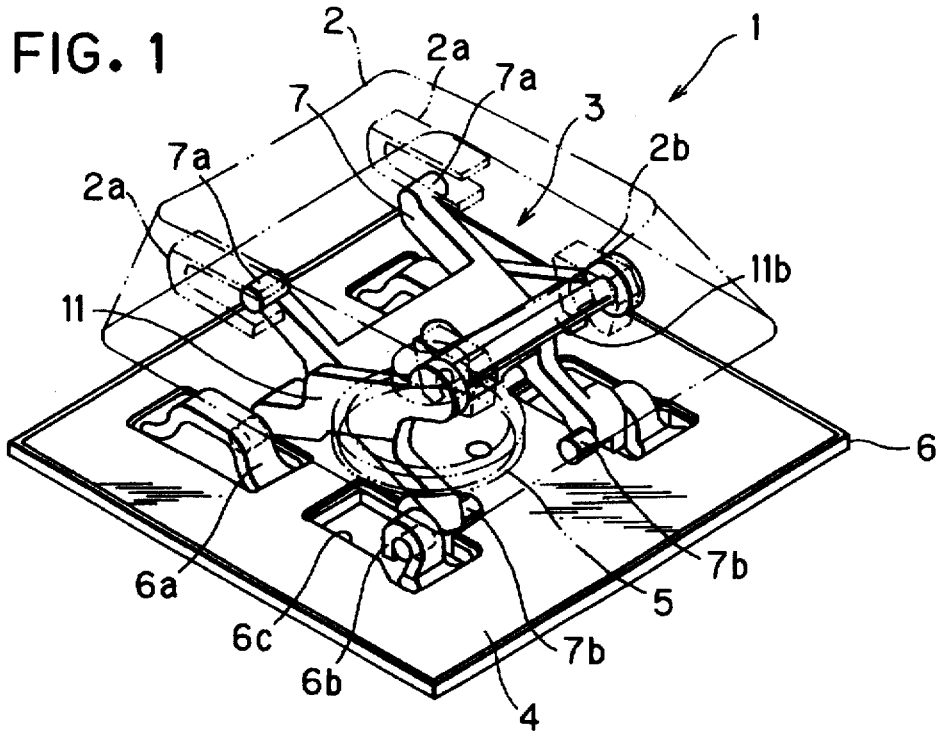
FIG. 1 is a perspective view showing configuration of a key switch device according to a first embodiment of the present invention.
Figure 2:
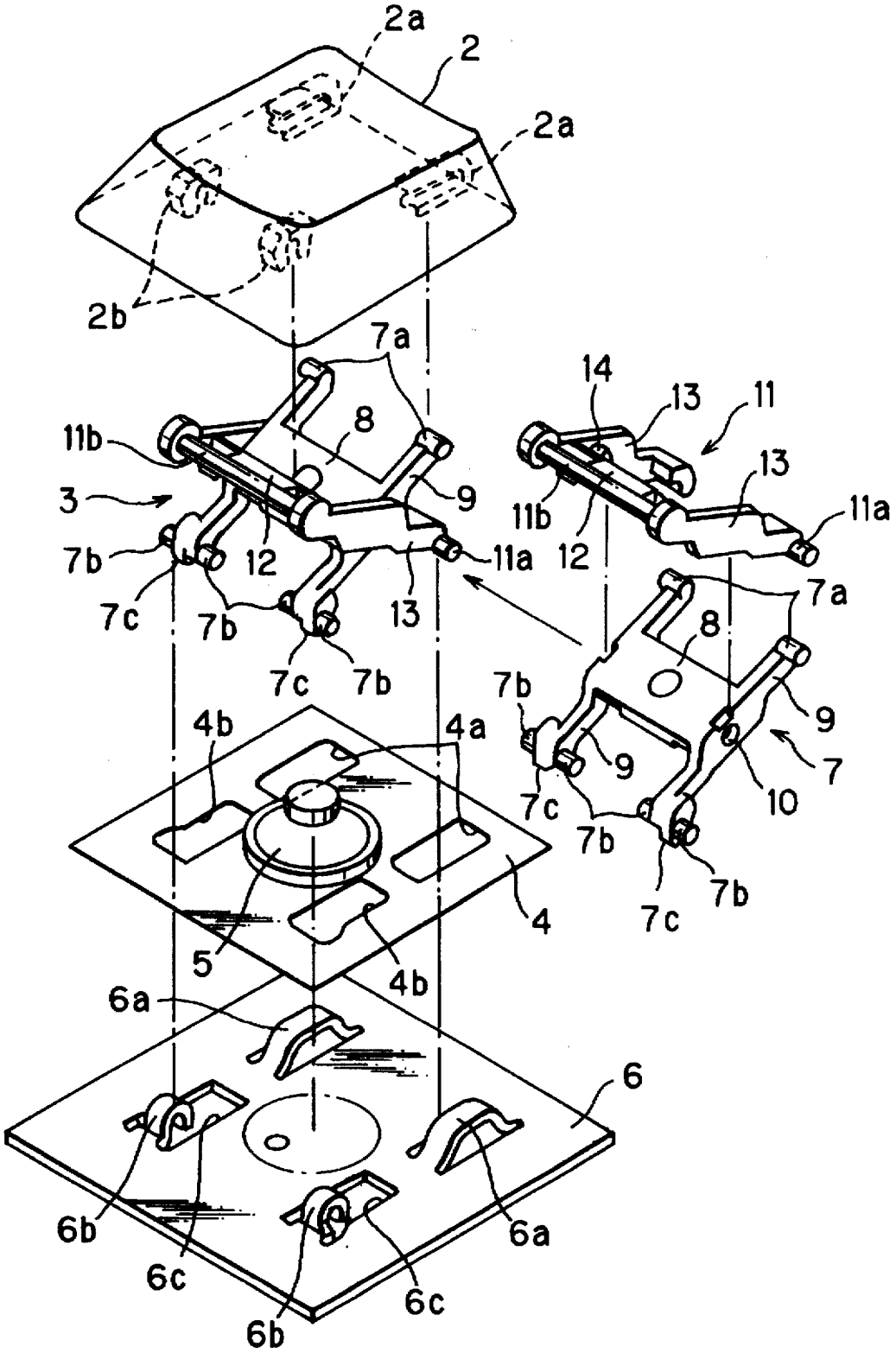
FIG. 2 is an exploded perspective view showing configuration of the components of the key switch device according to the first embodiment.
Figure 3A:
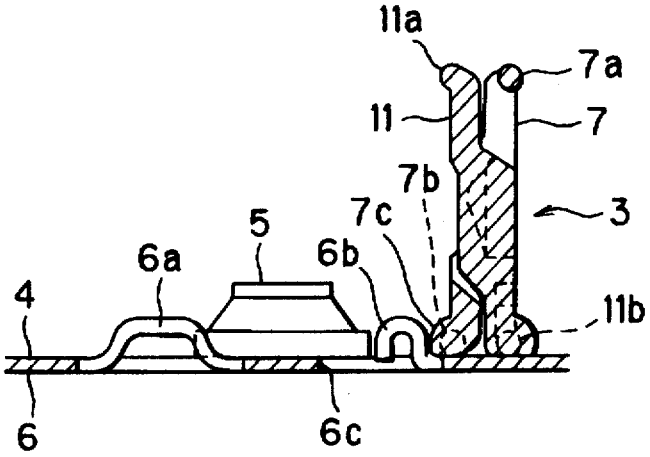
FIGS. 3(*a*) through 3(*d*) are cross-sectional side views show different-stages in assembly of the key switch device.
Figure 3B:
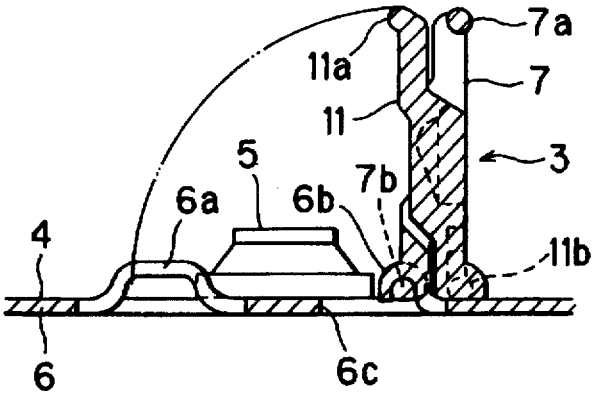
Figure 3C:
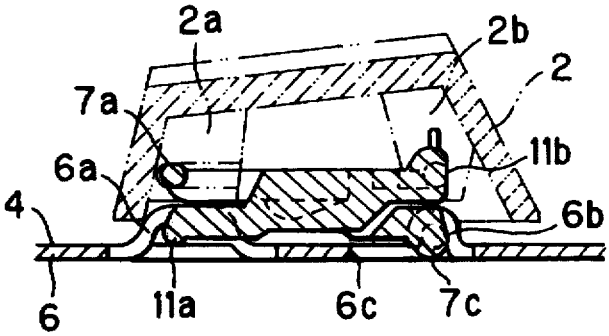
Figure 3D:
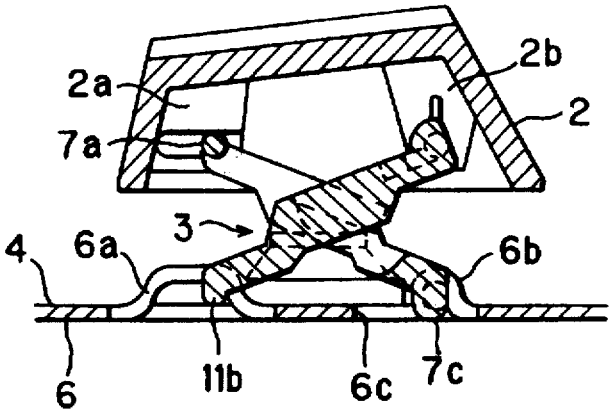

A key switch device 1 according to a first embodiment of the present invention will be described while referring to FIGS. 1 to 2, wherein like parts and components are designated by the same reference numerals to avoid duplicating description. FIG. 1 is a perspective view showing configuration of the key switch device 1 according to the first embodiment. FIG. 2 is an exploded perspective view showing configuration of the components of the key switch device 1.

As shown in FIGS. 1 and 2, the key switch device includes a key top 2; a guide member 3 serving as a guide support member including a first link member 7 and a second link member 11 which act in association to guide vertical movement of the key top 2 and to support the key top 2 in a horizontal condition; a flexible circuit board 4 on which is printed an electrical pattern for the key switch device 1; a rubber spring 5 which supports the guide member 3 on its upper surface and which is fixed at a predetermined position corresponding to a fixed contact portion of the electrical circuit pattern printed on the flexible circuit board 4; and a base plate 6 on which is mounted the flexible circuit board 4. The guide member 3 is supported between the key top 2 and the base plate 6.

The key top 2 is formed from, for example, ABS resin. The upper surface of the key top 2 is printed with a predetermined symbol or character (not shown in the drawings). A pair of first holding portions 2*a* and a pair of second holding portions 2*b* are formed in the under surface of the key top 2. Each first holding portion 2*a* is formed with an elongated channel and each second holding portion 2*b* is formed with a round hole. Both of the first holding portions 2*a* slidably support a first sliding pin 7*a* so that it can slide in a horizontal direction. Both of the first sliding pins 7*a* are formed in the first link member 7 of the guide member 3 as will be described later. Both of the second holding portions 2*b* pivotally support a holding shaft 11*b* formed in second link member 11 as will be described later.

The guide member 3 is formed to pivotally support the first link member 7 and the second link member 11. Next, an explanation will be provided for configuration of the first link member 7 and the second link member 11 while referring to FIG. 2.

First, an explanation will be provided for configuration of the first link member 7. The first link member 7 is formed from a composite resin such as polyacetal resin. As shown in FIG. 2, the first link member 7 has an approximately H shape in plan view. The first link member 7 includes a base portion 8 and a pair of plate portions 9 formed on opposite ends of the base portion 8. One first sliding pin 7*a* is formed to protrude outward from one tip of both plate portions 9. One of two holding pins 7*b* is provided to both plate portions 9 at the end opposite the first sliding pins 7*a*. Both of the sliding pins 7*a*, as described above, are slidably supported in a corresponding first holding portion 2*a* formed to the under surface of the key top 2. One holding pin 7*b* is pivotally supported in one of two fourth holding portions 6*b* formed in the base plate 6 as will be described later. One of two protrusion portions 7*c* is provided adjacent to each of holding pins 7*b* as will be described later. One of two protrusion portions 7*c* for engaging in open portions 6*c* of the base plate 6 is provided to the plate portions at the tips to which the second holding pins 7*b* are provided. A shaft reception hole 10 is opened at the approximate center of the both plate portions 9. Two pivot shafts 14 formed to plate portions 13 of the second link member 11 fit in corresponding shaft holes 10, so that the first link member 7 and the second link member 11 are pivotally supported by each other.

Next, an explanation will be provided for the configuration of the second link 11. As is the case with the first link member 7, the second link member 11 is formed from polyacetel resin. The second link member 11 is formed in a substantially C shape when viewed in plan perspective. The second link member 11 includes a base portion 12 and a pair of plate portions 13 formed on either end of the base portion 12. A second sliding pin 11*a* is formed on one tip of each plate portion 13 so as to protrude outward. A holding shaft 11*b* is provided spanning the plate portions 13 between tips thereof opposite the tips formed with the second sliding pins 11*a*. Each second sliding pin 11*a* is slidably supported in a corresponding one of two third holding portions 6*a* formed to the base plate 6 as will be described later. The holding shaft 11*b* is pivotally supported in the second holding portion 2*b* formed to the under surface of the key top 2 as described above. Pivot shafts 14 are provided substantially to the center of either plate portion 13 so as to protrude inward. Each pivot shaft 14 fits in one of the pivot holes 10 opened in each plate portion 9 of the first link member 7 as described above.

The guide member 3 is configured by fitting the pivot shaft 14 of the second link member 11 in the pivot hole 10 of the first link member 7. As a result, the first link member 7 and the second link member 11 can be pivoted with respect to each other in the same manner as a pair of scissors. It should be noted that the four distances from the center of the pivot hole 10 of the first link member 7 to the center of the first sliding pin 7*a* and to the center of the holding pin 7*b* and from the center of the pivot shaft 14 of the second link member 11 to the center of the second sliding pin 11*a* and to the holding shaft 11*b* are substantially the same.

The flexible circuit board 4 is formed from a flexible resin film. Open portions 4*a*, 4*b* through which the third holding portion 6*a* and the fourth holding portion 6*b* of the base plate 6 respectively pass through are formed in the flexible circuit board 4. Although not shown in the drawings, an electrical circuit pattern for the key switch device 1 is printed on the flexible circuit board 4. The rubber spring 5 is fixed at a position corresponding to a fixed contact portion of the electrical circuit pattern.

The base plate 6 is formed from a metal or a sufficiently rigid resin. The third holding portions 6*a* for slidably supporting the second sliding pins 11*a* of the second link member 11 and the fourth holding portions 6*b* for pivotally supporting the holding pins 7*b* of the first link member 7 are formed in the base plate 6. Open portions 6*c* are opened in the base plate 6. When the second slide pins 11*a* and the second holding pins 7*b* of the guide member 3 are attached to the base plate 6, the protrusion portions 7*c* of the first link member 7 are engaged in the open portions 6*c*.

Next, an explanation will be provided for a method for assembling the key switch device 1 of the present invention while referring to FIGS. 3(*a*) through 3(*d*). The FIGS. 3(*a*) through 3(*d*) show different stages in assembly of the key switch device 1.

First, as shown in FIG. 3(*a*), the flexible circuit board 4 is mounted on the base plate 6 so that the third holding portions 6*a* and the fourth holding portions 6*b* of the base plate 6 pass through corresponding open portions 4*a*, 4*b* of the flexible circuit board 4.

Next, the guide member 3 is attached to the base plate 6. As described above, the pivot shafts 14 of the second link member 11 are pivotally supported in the pivot holes 10 of the first link member 7 so that the guide member 3 is pivotally supported in a manner of a pair of scissors. As shown in FIG. 3(*a*), the folded-up guide member 3 is placed in an upright posture on the base plate 6. Then the holding pins 7*b* of the first link member 7 are inserted into the second holding portions 6*b* of the base plate 6 by bending the left and right plate portions 9 so that the pair of holding pins 7*b* of the first link member 7 move inward to be fitted into the second holding portions 6*b*. When the plate portions 9 must be bent to fit the holding pins 7*b*, the guide member 3 becomes difficult to separate from the base plate 6. Although not shown in the drawings, a bevel portion, serving as a deformation introduction portion, is provided at the tip of each holding pin 7*b* of the first link member 7. When the folded-up guide member 3 is oriented vertically as shown in FIG. 3(*a*), the protrusion portions 7*c* protrude leftward relative to the holding pins 7*b*. The protrusion portions 7*c* therefore do not obstruct insertion of the holding pins 7*b* into the second holding portions 6*b*.

As shown in FIG. 3(*b*), the holding pins 7*b* of the first link member 7 are then inserted into the second holding portions 6*b* of the base plate 6. When the bent first link member 7 is released, it reverts to its original shape. Because plate portions 9, the holding pins 7*b*, and the protrusion portion 7*c* are substantially at right angles to each other, the holding pins 7*b* can be inserted into the second holding portions 6*b*, but the protrusion portions 7*c* of the first link member 7 are unengagable with the open portions 6*c*, while the guide member is in the upright posture, that is, a closed-scissor condition, as shown in FIGS. 3(*a*) and 3(*b*). Therefore, the protrusion portions 7*c* will not interfere with the insertion process. Therefore, the holding pins 7*b* can be easily attached to the second holding portions 6*b*.

Next, as indicated in FIG. 3(*b*), posture of the guide member 3 is altered by pivoting the first link 7 around the holding pins 7*b*. In this inclining posture, wherein the guide member 3 is in an open-scissor condition, the protrusion portions 7*c* become engaged in the open portions 6*c*.

Then, the second slide pins 11*a* of the second link member 11 are inserted into the first holding portions 6*a* of the base plate 6. FIG. 3(*c*) shows the second slide pins 11*a* of the second link member 11 after being attached in the first holding portions 6*a* of the base plate 6 by bending the left and right pair of the second slide pins 11*a* of the second link portion 11 inward. Although not shown in the drawings, an edge of second slide pin 11*a* is beveled to facilitate introduction of the slide pins 11*a* into the first holding portion 6*a*. Then, the bent second link member 11 is released and allowed to revert to its original shape. At this point, the protrusion portion 7*c* of the first link member 7 is engaged in the open portion 6*c* of the base plate 6 so that the guide member 3 is difficult to separate from the base plate 6 in the horizontal direction. The key top 2 is then mounted to the guide member 3 as indicated by the one-lined chain line in FIG. 3(*c*).

Next, a user inserts the first slide pin 7*a* and the holding shaft 11*b* of the guide member 3 into the first holding portion 2*a* and the second holding portion 2*b* respectively of the key top 2. When the user releases his or her grip, the guide portion 3 resiliently springs up as a result of being mounted on the rubber spring 5. The rubber spring 5 lifts the guide member 3 upward into a slanting posture to the range limited by the third holding portion 6*a* of the base plate 6 with respect to the second slide pin 11*a* of the second link member 11. In this example, protrusion portions 7*c* of the first link member 7 engaged in the open portion 6*c* of the base plate 6 are only capable of pivoting within the range shown in FIGS. 3(*c*) and (*d*). In this inclining posture, wherein the guide member 3 is in an open-scissor condition, the protrusion portions 7*c* are still engaged in the open portions 6*c*. Accordingly, the protrusion portions 7*c* of the first link 7 are constantly engaged with the open portions 6*c* of the base plate 6 during the normal operation of the keyboard. Therefore, the guide member 3 is prevented from separating from the base plate 6 in the horizontal direction by the protrusion portions 7*c* and in the vertical direction by the second holding pins 7*b*. This completes the assembly of the key switch device 1 according to the first embodiment.

Figure 4:
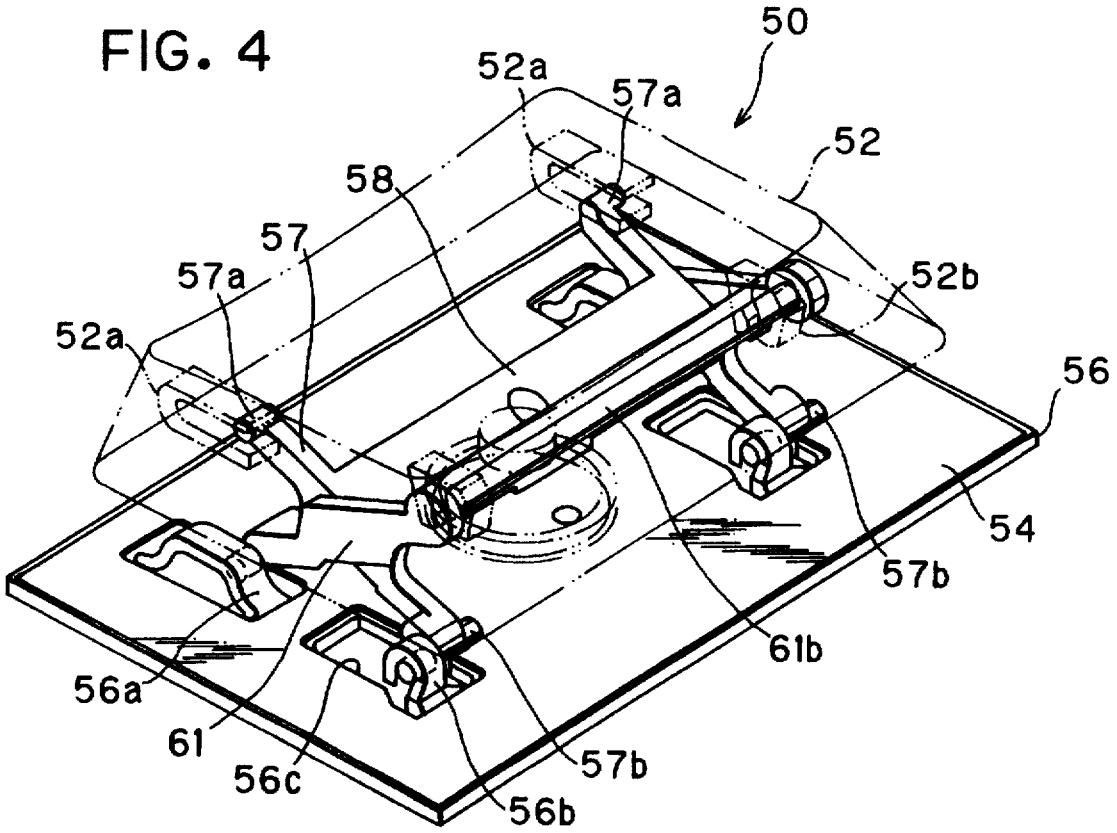
FIG. 4 is a perspective view showing a key switch device according to a second embodiment of the present embodiment.
Figure 5:
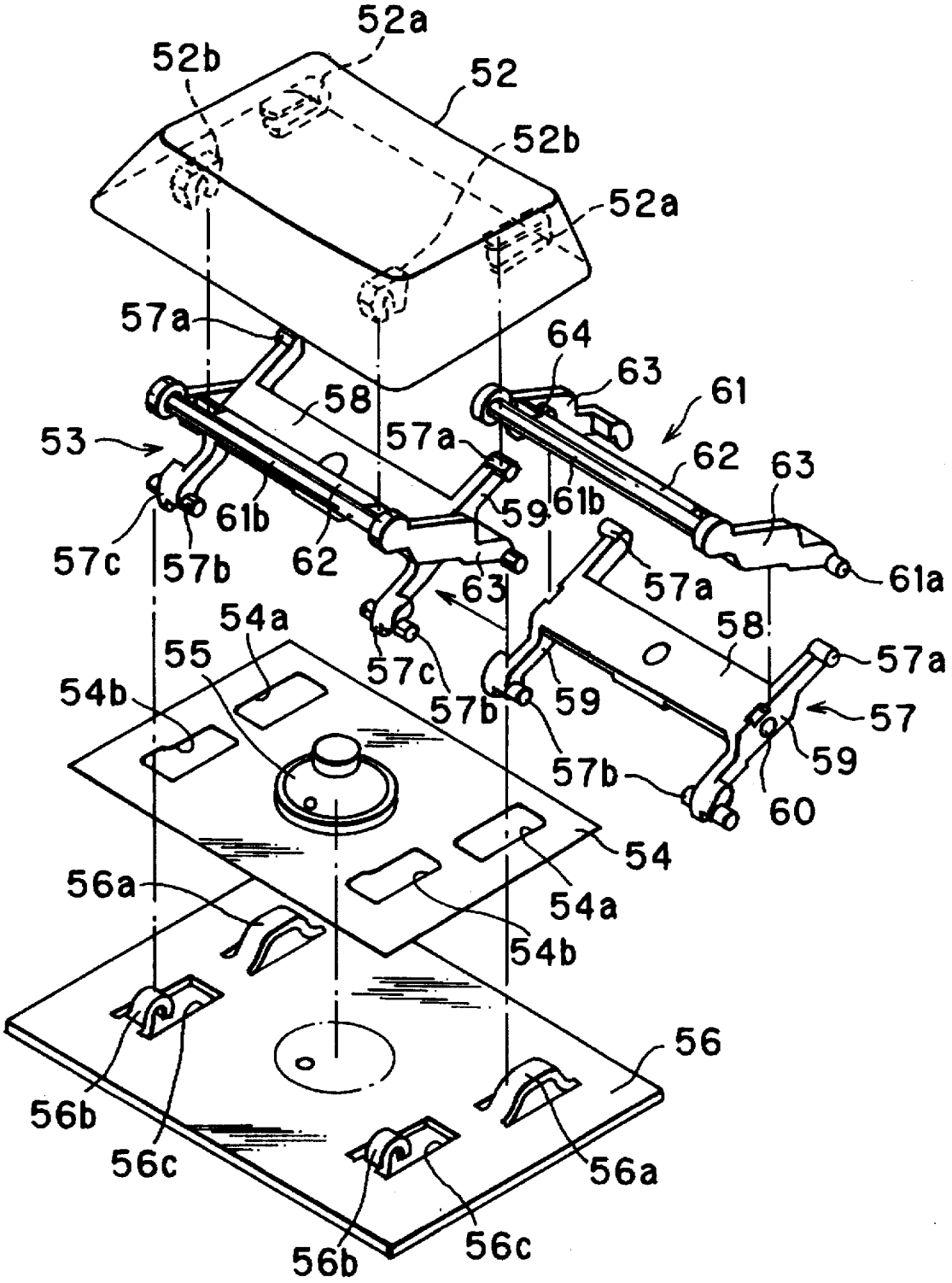
FIG. 5 is an exploded perspective view showing the key switch device according to the second embodiment.

Next, a key switch device according to a second embodiment of the present invention will be described while referring to FIGS. 4 and 5. FIG. 4 is a perspective view showing a key switch device according to the second embodiment. FIG. 5 is an exploded perspective view of the key switch device according to the second embodiment.

As shown in FIG. 4 and FIG. 5, a key switch device 50 has the same basic configuration as the key switch device 1 of the first embodiment. The key switch 50 includes a key top 52; a guide member 53 serving as a guide support member for guiding vertical movements and supporting in horizontal direction of the key top 52; a flexible circuit board 54 on which is printed an electrical circuit pattern of the key switch device 50; a rubber spring 55 on which is mounted the guide member 53 and which is fixed at the position corresponding to fixed contact portions of the circuit pattern printed on the flexible circuit board 54; and a base plate 56 on which the flexible circuit board 54 is mounted and which supports the guide member 53 between itself and the key top 52.

The key top 52 is formed from, for example, ABS resin. The upper surface of the key top 52 is printed with a predetermined symbol or character (not shown in the drawings). A pair of first holding portions 52*a* and a pair of second holding portions 52*b* are formed in the under surface of the key top 52. Each first holding portion 52*a* is formed with an elongated channel and each second holding portion 52*b* is formed with a round hole. Both of the first holding portions 52*a* slidably support a first sliding pin 57*a* so that it can slide in a horizontal direction. Both of the first sliding pins 57*a* are formed in the first link member 57 of the guide member 53 as will be described later. Both of the second holding portions 52*b* pivotally support a holding shaft 61*b* formed in a second link member 61 as will be described later.

The guide member 53 is formed to pivotally support the first link member 57 and the second link member 61. Next, an explanation will be provided for configuration of the first link member 57 and the second link member 61 while referring to FIG. 5.

First, an explanation will be provided for configuration of the first link member 57. The first link member 57 is formed from a composite resin such as polyacetal resin. As shown in FIG. 5, the first link member 57 has an approximately H shape in plan view. The first link member 57 includes a base portion 58 and a pair of plate portions 59 formed on opposite ends of the base portion 58. One first sliding pin 57*a* is formed to protrude outward from one tip of both plate portions 59. One of two holding pins 57*b* is provided to both plate portions 59 at the end opposite the first sliding pins 57*a*. Both of the sliding pins 57*a*, as described above, are slidably supported in a corresponding first holding portion 52*a* formed to the under surface of the key top 52. One holding pin 57*b* is pivotally supported in one of two fourth holding portions 56*b* formed in the base plate 56 as will be described later. One of two protrusion portions 57*c* is provided adjacent to the each of holding pins 57*b* as will be described later. One of two protrusion portions 57*c* for engaging in open portions 56*c* of the base plate 56 is provided to the plate portions at the tips to which the second holding pins 57*b* are provided. A shaft reception hole 60 is opened at the approximate center of both the plate portions 59. Two shafts 64 formed to the plate portions 63 of the second link member 61 fit in corresponding shaft holes 60, so that the first link member 57 and the second link member 61 are pivotally supported by each other.

Next, an explanation will be provided for the configuration of the second link 61. As is the case with the first link member 57, the second link member 61 is formed from polyacetel resin. The second link member 61 is formed in a substantially C shape when viewed in plan perspective. The second link member 61 includes a base portion 62 and a pair of plate portions 63 formed on either end of the base portion 62. A second sliding pin 61*a* is formed on one tip of each plate portion 63 so as to protrude outward. A holding shaft 61*b* is provided spanning the plate portions 63 between tips thereof opposite the tips formed with the second sliding pins 61*a*. Each second sliding pin 61*a* is slidably supported in a corresponding one of two third holding portions 56*a* formed to the base plate 56 as will be described later. The holding shaft 61*b* is pivotally supported in the second holding portion 52*b* formed to the under surface of the key top 52 as described above. A pivot shaft 64 is provided substantially to the center of either plate portion 63 so as to protrude inward. Each pivot shaft 64 fits in one of the pivot holes 60 opened in each plate portion 59 of the first link member 57 as described above.

The guide member 53 is configured by fitting the pivot shaft 64 of the second link member 61 in the pivot hole 60 of the first link member 57. As a result, the first link member 57 and the second link member 61 can be pivoted with respect to each other in the same manner as a pair of scissors. It should be noted that the four distances from the center of the pivot hole 60 of the first link member 57 to the center of the first sliding pin 57*a* and to the center of the holding pin 57*b* and from the center of the pivot shaft 64 of the second link member 61 to the center of the second sliding pin 61*a* and to the holding shaft 61*b* are substantially the same.

The flexible circuit board 54 is formed from a flexible resin film. Open portions 54*a*, 54*b* through which the third holding portion 56a and the fourth holding portion 56b of the base plate 56 respectively pass through are formed in the flexible circuit board 54. Although not shown in the drawings, an electrical circuit pattern for the key switch device 51 is printed on the flexible circuit board 54. The rubber spring 55 is fixed at a position corresponding to a fixed contact portion of the electrical circuit pattern.

The base plate 56 is formed from a metal or a sufficiently rigid resin. The third holding portions 56a for slidably supporting the second sliding pins 61a of the second link member 61 and the fourth holding portions 56b for pivotally supporting the holding pins 57b of the first link member 57 are formed in the base plate 56. Open portions 56c are opened in the base plate 56. When the second slide pins 61a and the second holding pins 57b of the guide member 53 are attached to the base plate 56, the protrusion portions 57c of the first link member 57 engage in the open portions 56c.

In the second embodiment, left and right protrusion portions 57c of a first link member 57 are not symmetrical in the left and right directions as viewed in FIG. 5, but instead are formed with the same shape facing the same direction. Also, the left and right open portions 56c are not symmetrical in the left and right directions, but are provided with the same shape for engaging with respective protrusion portions 57c of the first link member 27. For this reason, when attaching the first link member 57 to the base plate 56, the holding pins 57b of the first link member 57 are positioned unilaterally to corresponding third holding portions 56a and slid unidirectionally to engage in the third holding portions 56a. Therefore, without deforming the first link member 57, the holding pins 57b can be inserted into a portion of the base plate 56 formed by bending processes. In this way, the holding pins 57b are easier to engage in the third holding portions 56a.

While the invention has been described in detail with reference to specific embodiments thereof, it would be apparent to those skilled in the art that various changes and modifications may be made therein without departing from the spirit of the invention, the scope of which is defined by the attached claims.

Figure 6:
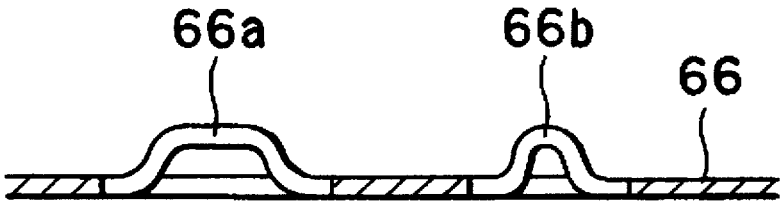
FIGS. 6 and 7 are cross-sectional side views showing third and fourth engagement portions of a base plate according to modifications of the first and second embodiments.
Figure 7:
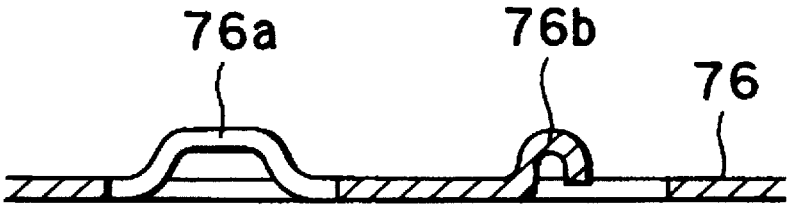

For example, instead of the base plate shown in FIG. 3, a base plate 66 or 76 formed with third and fourth engagement portions 66a, 66b, 76a, and 76b, shown in FIGS. 6 and 7 respectively can be used. The fourth engagement portions 66b and 76b shown in FIGS. 6 and 7 can be formed by bending metal plate or by drawing press processes.

According to the above-described embodiments, a flexible circuit board 4, 54 with an electrical pattern printed thereon is mounted to a base plate 6, 56 and a rubber spring 5, 55 is fixed to the flexible circuit board 4, 54 at a position corresponding to an electrical contact. However, the electrical circuit can be printed directly on the surface of the base plate 6, 56 and the rubber spring 5, 55 can be attached to the base plate 6, 56 at the position corresponding to an electrical contact. In this case, the flexible circuit board 4, 54 becomes unnecessary so that overall cost of the key switch device decreases.

Although in the above described embodiment, the flexible circuit board 4, 54 was mounted on the base plate 6, 56 and the rubber spring 5, 55 was fixed to the flexible circuit board 4, 54 at the position corresponding to an electrical contact thereon, the holding portions could be formed on a separate resin frame holder instead of on the base plate. The resin frame holder for holding the guide member could be disposed over the flexible circuit board on which is printed an electrical circuit pattern. Furthermore, beneath the flexible circuit board, a support plate could be provided for supporting the flexible circuit board. Alternatively, the support plate on which is printed an electrical circuit pattern could be disposed beneath the frame holder.

In a key switch device according to the present invention, the guide member is provided with at least one protrusion for engaging with an open portion of the base plate. Therefore, it becomes difficult for the guide support member to separate from the holding member even if the key top is forcefully pressed forward, backward, leftward, or rightward. Furthermore, even if the key top is forcefully pulled upward, the guide support member will be prevented from separating from the holding member.

Also, the guide support member is easy to attach to the holding member because the protrusion does not engage in the opening when attaching the guide support member to the holding member, but the protrusion engage with the open portion after the guide support member has been attached to the holding member.

What is claimed is:

1. A key switch device comprising:

a key top including a first holding portion and a second holding portion;

a holding member including a third holding portion in confrontation with the first holding portion and a fourth holding portion in confrontation with the second holding portion, the holding member being formed with an open portion adjacent to at least one of the third holding portion and fourth holding portion; and a scissor-like guide support member disposed between the key top and the holding member and including a first link member supported by the first holding portion and the fourth holding portion, a second link member supported by the second holding portion and the third holding portion, and a shaft portion pivotally supporting the first link member and the second link member, at least one of the first link member and the second link member including a pin engaged in a corresponding one of the third holding portion and the fourth holding portion, the pin protruding in a horizontal direction, the guide support member guiding the key top in a vertical direction by switching between an open-scissor condition and a closed-scissor condition according to scissor-like movements of the first link member and the second link member pivotally supported on the shaft support, the guide support member including at least one protrusion engaging with the open portion for preventing separation between the guide support member and the holding member, the protrusion protruding in a direction non-parallel with the horizontal direction.

2. A key switch device as claimed in claim 1 further comprising:

a circuit board formed with a switching electrode and disposed between the guide support member and the holding member; and a switching member for performing switching operations in correspondence with vertical movements of the key top, the switching member being disposed on the circuit board at a position in correspondence with the switching electrode and the guided support member being resiliently mounted on the switching member.

3. A key switch device as claimed in claim 1 wherein the holding member is formed with a switching electrode and further comprises a switching member for performing switching operations in correspondence with vertical movements of the key top, the switching member being disposed on the holding member at a position in correspondence with the switching electrode and the guided support member being resiliently mounted on the switching member.

4. A key switch as claimed in claim 1, wherein the first link member and the second link member of the guide support member are formed from a bendable material and wherein the third and fourth holding portions of the holding member are positioned within a range at which the first link member and the second link member are bendable.

5. A key switch as claimed in claim 1 wherein the third and fourth holding portions of the holding member are positioned so that the guide support member is slidably engagable with the third and first holding portions.

6. A key switch as claimed in claim 1 wherein the protrusion is unengagable in the open portion when the guide member is in an upright posture and is engagable in the open portion when the guide member is in a slanting posture and an inclining posture, the guide support member being in the slanting posture and the inclining posture in the open-scissor condition and a closed-scissor condition respectively.

7. A key switch as claimed in claim 6 wherein the protrusion portion and holding pins of the guide member are formed to a plate of the guide member so that the protrusion portion, the holding pins, and the guide member are at substantially right angles to each other.

8. A key switch as claimed in claim 1 wherein at least one of the first link member and the second link member includes a pin engaged in a corresponding one of the third holding portion and the fourth holding portion, the pin preventing separation between the guide support member and the holding member in the vertical direction and the protrusion preventing separation between the guide support member and the holding member in a horizontal direction.

9. A key switch as claimed in claim 1 wherein at least one of the third holding member and the fourth holding member are formed by bending a portion of the holding member.

10. A key switch as claimed in claim 1 wherein:

the third holding portion includes two members shaped symmetrical with each other;

the fourth holding member portion includes two members shaped symmetrical with each other;

the first link member includes two engaging members engaging with corresponding ones of the two members of the fourth holding portion from opposite sides of the two members of the fourth holding portion; and the second link includes two engaging members engaging with corresponding ones of the two members of the third holding portion from opposite ides of the two members of the third holding portion.

11. A key switch as claimed in claim 1 wherein:

the third holding portion includes two members having a same shape;

the fourth holding portion includes two members having a same shape;

the first link member includes two engaging members engaging with corresponding ones of the two members of the fourth holding portion from same sides of the two members of the fourth holding portion; and the second link includes two engaging members engaging with corresponding ones of the two members of the third holding portion from same sides of the two members of the third holding portion.

12. A method of assembling a key switch comprising the steps of:

assembling a scissor-like guide member by pivotally supporting a first link member with respect to a second link member;

fitting a pair of holding pins of the first link member to a pair of first holding portions of a base plate;

altering posture of the guide member to engage a protrusion of the first link member in a hole in the base plate; and fitting a pair of holding pins of the second link member to a pair of second holding portions of the base plate.

13. A method as claimed in claim 12 wherein the protrusion portion and the holding pins of the guide member are formed to a plate of the guide member so that the protrusion portion, the holding pins, and the guide member are at substantially right angles to each other.

14. A method as claimed in claim 12 wherein the step of fitting the pair of holding pins of the first link member to the pair of first holding portions of the base plate further includes the steps of:

bending the first link member inward so that a pair of holding pins of the first link member approach each other;

positioning the holding pins between a pair of first holding portions of a base plate; and releasing the first link member so that it elastically reverts to its original shape, whereupon the holding pins of the first link member fit into the first holding portions.

15. A method as claimed in claim 12 wherein the step of fitting the pair of holding pins of the first link member to the pair of first holding portions of the base plate further includes the steps of:

positioning the holding pins unilaterally adjacent to corresponding ones of the first holding portions of the base plate; and sliding the first link member unidirectionally into engagement with corresponding ones of the first holding portions of the base plate.

* * * * *